US007237404B2

(12) United States Patent
Morano et al.

(10) Patent No.: US 7,237,404 B2
(45) Date of Patent: Jul. 3, 2007

(54) FRIGORIE ACCUMULATOR

(75) Inventors: Giuseppe Morano, Pomaro Monferrato (IT); Giovanni Rosso, Terruggia (IT)

(73) Assignee: Cold Car S.R.L., Occimiano (Alessandria) (IT)

( * ) Notice: Subject to any disclaimer, the term of this patent is extended or adjusted under 35 U.S.C. 154(b) by 104 days.

(21) Appl. No.: 11/001,120

(22) Filed: Dec. 2, 2004

(65) Prior Publication Data

US 2006/0117788 A1 Jun. 8, 2006

(51) Int. Cl.
*F25D 17/02* (2006.01)

(52) U.S. Cl. ..... 62/434; 62/509

(58) Field of Classification Search ..... 62/434, 62/438, 439, 441, 443, 451, 452, 453, 509
See application file for complete search history.

(56) References Cited

U.S. PATENT DOCUMENTS 4,382,437 A * 5/1983 Woods et al. ..... 126/586
4,422,305 A * 12/1983 Grosskopf ..... 62/430
4,550,575 A * 11/1985 DeGaynor ..... 62/308
4,637,222 A * 1/1987 Fujiwara et al. ..... 62/244
4,658,601 A * 4/1987 Burchell et al. ..... 62/51.1
5,211,900 A * 5/1993 Ziegler ..... 264/263
5,239,839 A * 8/1993 James ..... 62/434
5,475,982 A * 12/1995 Laude-Bousquet ..... 62/59
6,105,659 A * 8/2000 Pocol et al. ..... 165/10
6,216,469 B1 * 4/2001 Miller ..... 62/59
6,220,337 B1 * 4/2001 Chen et al. ..... 165/10
6,220,338 B1 * 4/2001 Grandi ..... 165/48.1
6,564,471 B1 * 5/2003 Sutherland et al. ..... 34/284

FOREIGN PATENT DOCUMENTS

EP 0 902 243 A 3/1999
EP 1 236 960 A 9/2000
GB 989 836 A 4/1965
GB 2 327 751 A 2/1999
JP 0213339 A1 * 3/1987

* cited by examiner

*Primary Examiner*—Mohammad M. Ali
(74) *Attorney, Agent, or Firm*—Sughrue Mion, PLLC

(57) ABSTRACT

The frigorie accumulator comprises a housing which defines in its interior a region for holding a frigorie storage substance such as a eutectic solution, and at least one duct which extends in a heat-exchange relationship with the housing and can contain a refrigerant fluid for removing calories from the storage substance held in the housing until it brings about freezing thereof. The housing comprises: a substantially tubular, extruded profiled section, made of a thermally conductive material, defining first heat-exchange walls between the region and the environment outside the housing, and second heat-exchange walls between the region and the refrigerant fluid contained in the duct, and a first end closure element and a second end closure element which can be connected in a fluid-tight manner to the ends of the extruded profiled section.

10 Claims, 9 Drawing Sheets

FRIGORIE ACCUMULATOR

BACKGROUND OF THE INVENTION

The present invention relates to a frigorie or cold accumulator.

More specifically, the subject of the invention is a frigorie accumulator comprising:

a housing which defines in its interior a region for holding a frigorie storage substance such as a eutectic solution, and at least one duct which extends at least partly in a heat-exchange relationship with the region inside the housing and can contain a refrigerant fluid, particularly $CO_2$ or other high-pressure gases, for removing calories from the substance held in said region of the housing until it brings about freezing thereof.

Frigorie accumulators of this type are used, for example, as refrigeration units in the cells of refrigerated delivery vans which are used for the short-range transport and distribution of products at low temperature such as ice creams, frozen foods and the like, and so-called "fresh" products.

Frigorie accumulators of this type according to the prior art are produced substantially in two main types which are distinguished by the material which is used predominantly for their manufacture.

A first type of accumulator, which is made of plastics material, has a low weight but suffers from problems of reliability. Plastics materials in fact present problems when they are subjected to low operating temperatures, to considerable expansions/contractions, and to vibrations during transportation.

Accumulators of a second type, which are made of stainless steel, have good reliability and optimal behaviour at low temperatures but are quite expensive with regard both to the material used and to the operations that are necessary during manufacture.

SUMMARY OF THE INVENTION

An object of the present invention is to provide a frigorie accumulator which can be produced easily and inexpensively and which has optimal operative efficiency and good reliability.

This object is achieved, according to the invention, by a frigorie accumulator of the type specified above which is characterized primarily in that the housing comprises:

a substantially tubular, extruded profiled section, made of a thermally conductive material, defining at least one first heat-exchange wall between the region inside the housing and the environment outside the housing, and at least one second heat-exchange wall between the region inside the housing and the refrigerant fluid contained in said duct; and a first end closure element and a second end closure element which can be connected in a fluid-tight manner to the ends of the extruded profiled section.

The accumulator according to the invention can advantageously be made of aluminium or alloys thereof and is therefore very light.

Moreover, these materials have an extremely high coefficient of thermal conductivity (of the order of 200 W/m ° K.), clearly greater than that of plastics materials (typically of the order of 0.2 W/m ° K.) and of stainless steel (typically of the order of 16 W/m ° K.). The frigorie accumulator according to the invention is consequently characterized by good operative efficiency: thermal conductivity is extremely uniform along the accumulator and the rate of freezing of the storage substance is optimal.

The accumulator according to the invention is also very reliable since, in practice, no relative movement takes place between constituent parts in the longitudinal direction (corresponding to the direction of extrusion of the profiled element in the accumulator).

BRIEF DESCRIPTION OF THE DRAWINGS

Further characteristics and advantages of the invention will become clear from the following detailed description which is given purely by way of non-limiting example, with reference to the enclosed drawings, in which.

DETAILED DESCRIPTION OF THE INVENTION

Figure 1:
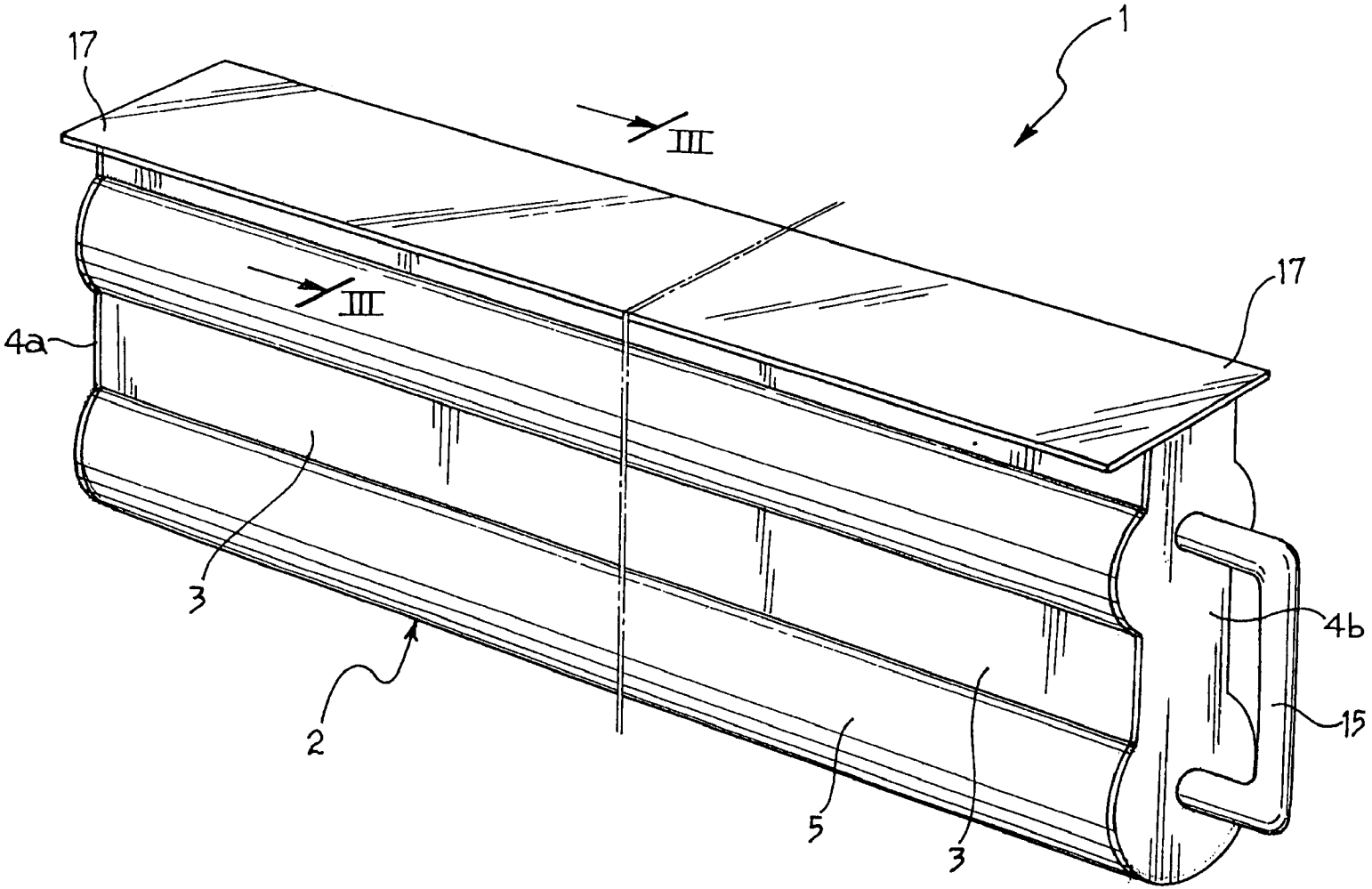
FIG. 1 is a perspective view of a frigorie accumulator according to the invention.

A frigorie accumulator according to the invention is generally indicated 1 in FIG. 1.

Figure 2:
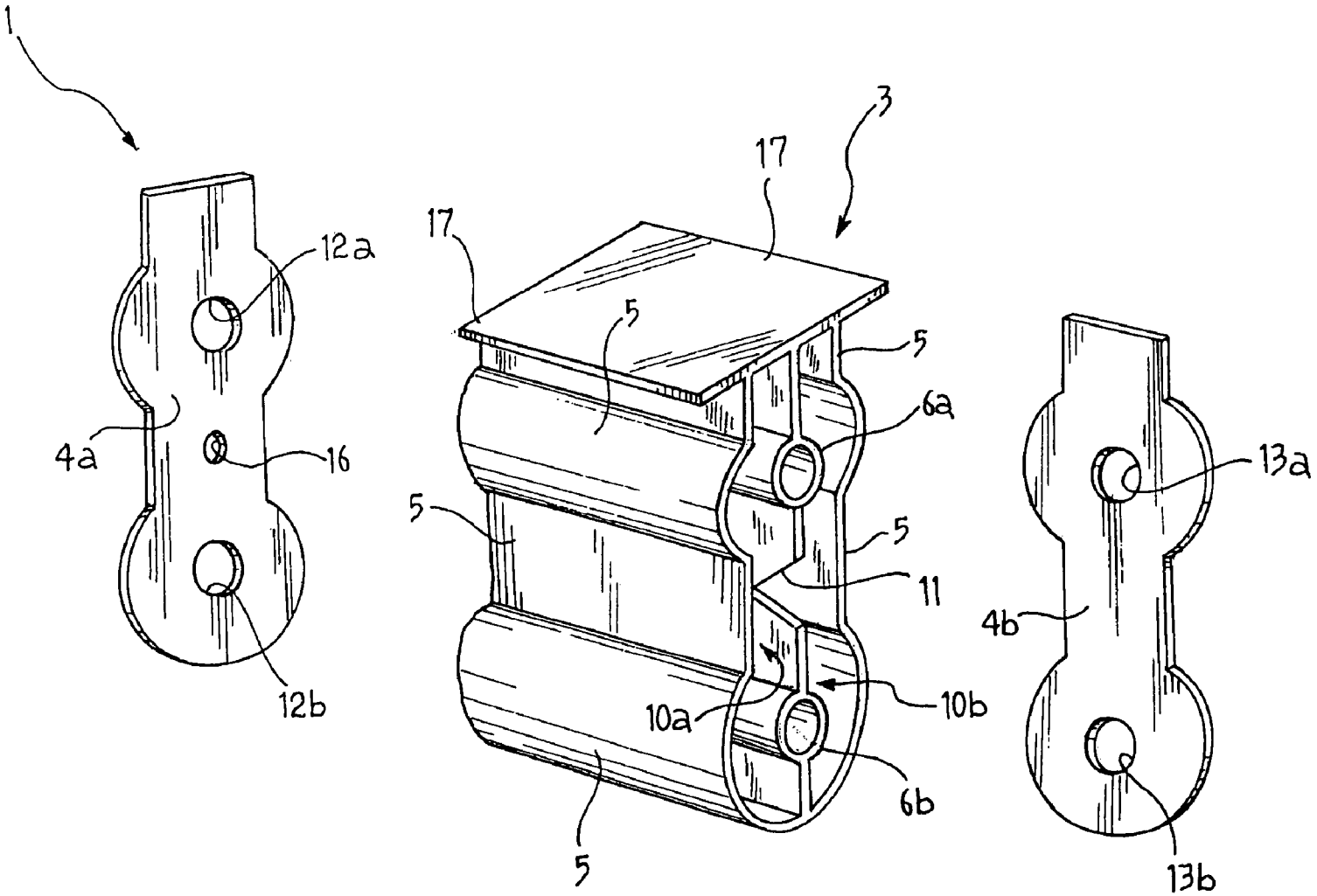
FIG. 2 is a partially-sectioned, partial, exploded, perspective view of the frigorie accumulator according to FIG. 1.

In the embodiment shown, the accumulator 1 comprises a housing 2 formed by a substantially tubular extruded profiled section 3 to the ends of which respective plate-shaped end closure elements 4*a*, 4*b* are welded (see also FIG. 2).

The extruded profiled section 3 and the end elements 4*a* and 4*b* are advantageously made of aluminium or alloys thereof.

Figure 3:
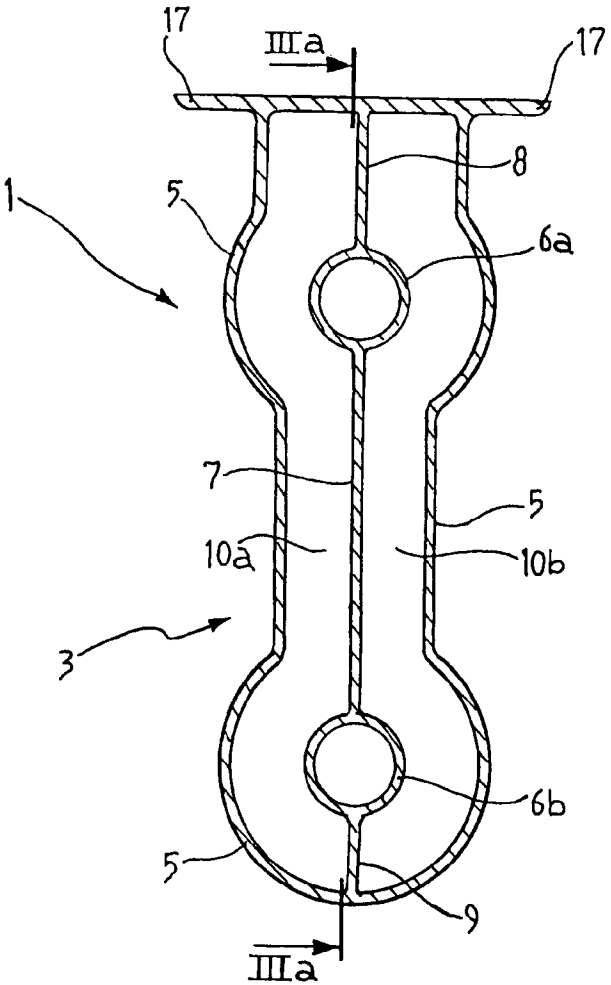
FIG. 3 is a cross-section taken on the line III—III of FIG. 1.

With reference to FIGS. 2 and 3, the extruded profiled section 3 defines a tubular wall 5 having an oblong cross-section.

The region inside the housing 2, that is, the region delimited by the outer wall 5 of the extruded profiled section 3 and by the end closure elements 4*a*, 4*b*, can hold a frigorie storage substance such as a eutectic solution of a type known per se.

In the embodiment shown from FIG. 1 to FIG. 8, the extruded profiled section 3 has two internal, tubular, shaped portions 6*a* and 6*b* which are integral therewith and which form two branches or portions of a duct for a refrigerant fluid (such as $CO_2$ or other high-pressure gases), which will be described further below.

As can be seen in particular in FIGS. 2 and 3, the internal, tubular, shaped portions 6*a* and 6*b* of the extruded profiled section 3 can be interconnected by a longitudinal wall or partition 7 integral with the profiled section. Moreover, said internal, tubular, shaped portions 6*a* and 6*b* can be connected to the external wall 5 of the profiled section 3 by means of respective connecting walls or partitions 8 and 9 which are also integral with the profiled section 3.

The connecting partitions 7, 8 and 9 are preferably coplanar as can be seen, for example, in FIG. 3. These partitions divide the region inside the housing 2 into two compartments or chambers, indicated 10*a* and 10*b*. An opening defined in at least one connecting partition puts these compartments or chambers 10*a*, 10*b* into communication with one another. In the embodiment shown, the opening is in the form of a triangular notch 11 (FIGS. 2, 3*a* and 3*b*) in the intermediate connecting partition 7.

The end closure elements 4*a*, 4*b* of the housing 2 have respective openings 12*a*, 12*b* and 13*a*, 13*b* (FIG. 2) in positions corresponding to the ends of the internal, tubular, shaped portions 6*a* and 6*b* of the extruded profiled section 3.

The end elements 4*a* and 4*b* are welded to the ends of the extruded profiled section 3.

Figure 3B:
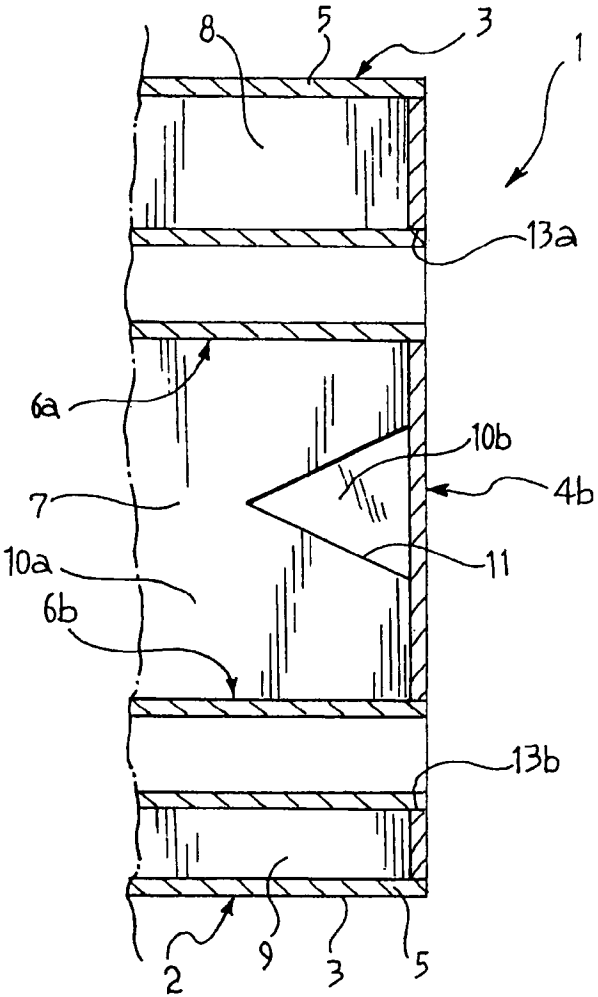
FIG. 3*b* is a view similar to that of FIG. 3*a* and shows a variant.
Figure 3A:
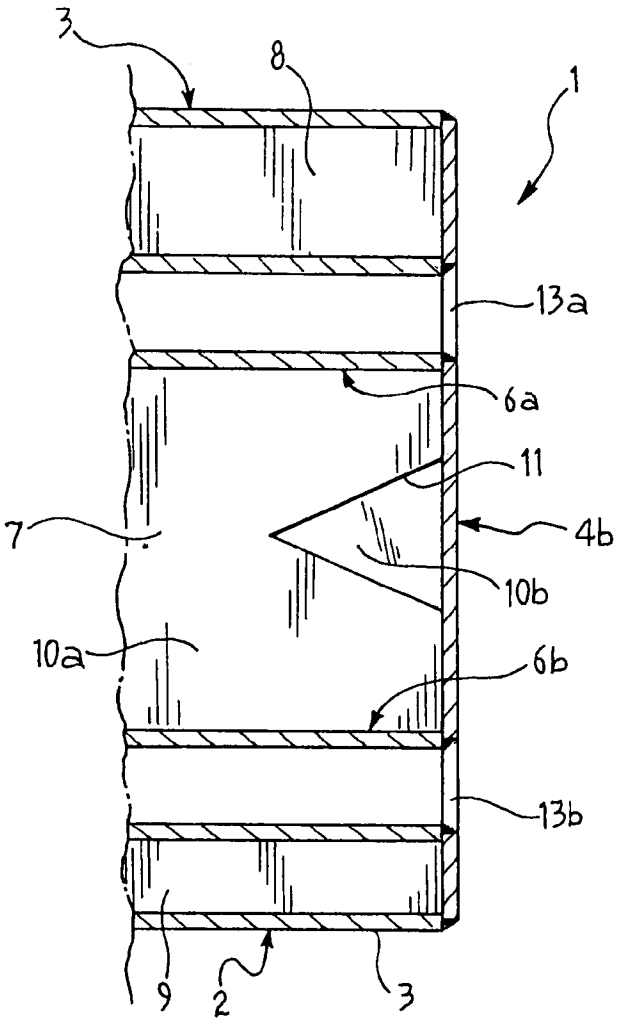
FIG. 3*a* is a partial view, sectioned substantially on the line IIIa—IIIa of FIG. 3.

In a first embodiment shown in FIG. 3*a*, these end elements 4*a*, 4*b* are placed in abutment with the ends of the profiled section 3 and are welded to said profiled section by TIG or laser welding in the region of their external profiles and of the edges or profiles of their openings 12*a*, 12*b* and 13*a*, 13*b*.

In an alternative embodiment to which FIG. 3*b* relates, the end elements 4*a*, 4*b* are brazed to the ends of the extruded profiled section 3, after the end edges of the interconnecting partitions 7, 8 and 9 have been milled to allow the end elements 4*a*, 4*b* to be inserted in the corresponding end portions of the profiled section 3; the end elements 4*a*, 4*b* thus extend inside the external wall 5 of the profiled element and around the ends of the internal tubular shaped portions 6*a*, 6*b*.

With reference to FIG. 1, the frigorie accumulator 1 further comprises a U-shaped or C-shaped portion of tubing 15 made of aluminium or an alloy thereof, the ends of which are inserted and welded in the openings of the end closure elements 4*a*, 4*b*. The tubing 15 interconnects the internal tubular shaped portions 6*a*, 6*b* of the extruded profiled section 3 in series with one another, forming a duct to which a refrigerant fluid for removing calories from the storage substance held in the communicating chambers 10*a*, 10*b* can be admitted in operation.

In the embodiment shown, the tubing 15 is connected to the end closure element 4*b* and the openings 12*a*, 12*b* of the other end element 4*a* enable the above-described duct to be connected to an external system such as a refrigeration system of a type known per se.

As can be seen from FIG. 2, at least one opening 16 is formed in one end element, advantageously in the end element indicated 4*a*; the opening 16 can be sealed in a fluid-tight manner known per se and enables a frigorie storage substance to be introduced into the region 10*a*, 10*b* defined inside the housing 2 of the accumulator.

The extruded profiled section 3 preferably but not necessarily has, on one side, an integral, flange-like, longitudinal, shaped portion, indicated 17 in the drawings. This shaped portion can be used for the fixing of the frigorie accumulator 1 to a supporting structure such as the wall of a cell of a refrigerated delivery van.

The external wall 5 of the extruded profiled section 3 may advantageously have external, longitudinal, shaped portions formed integrally in the extrusion for enabling accessory elements to be connected to the accumulator 1.

Figure 4:
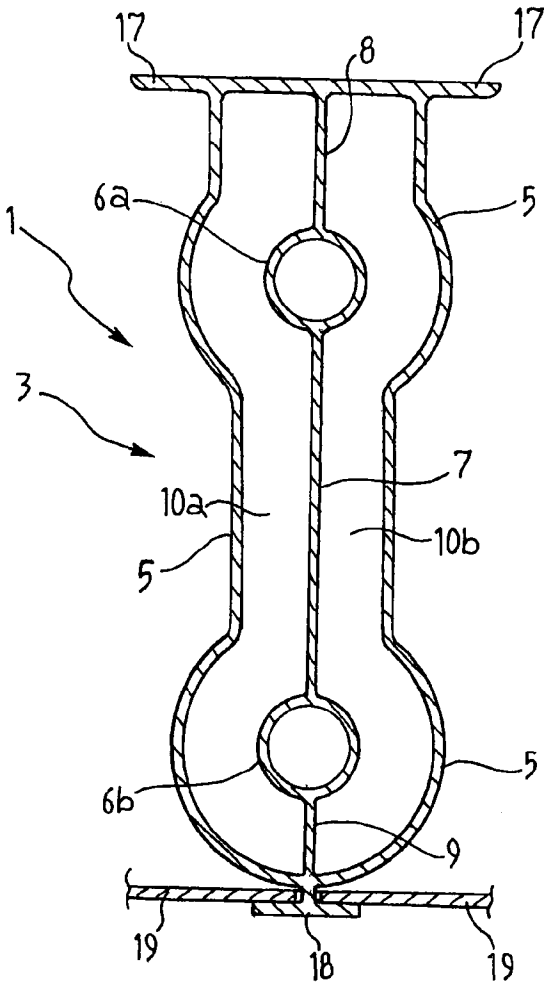
FIGS. 4 to 8 are cross-sections similar to that shown in FIG. 3 and show further variants.

By way of example, FIG. 4 shows such an external, longitudinal, shaped portion 18 which has a substantially inverted T-shape and can be used for supporting flat cover panels 19.

Figure 5:
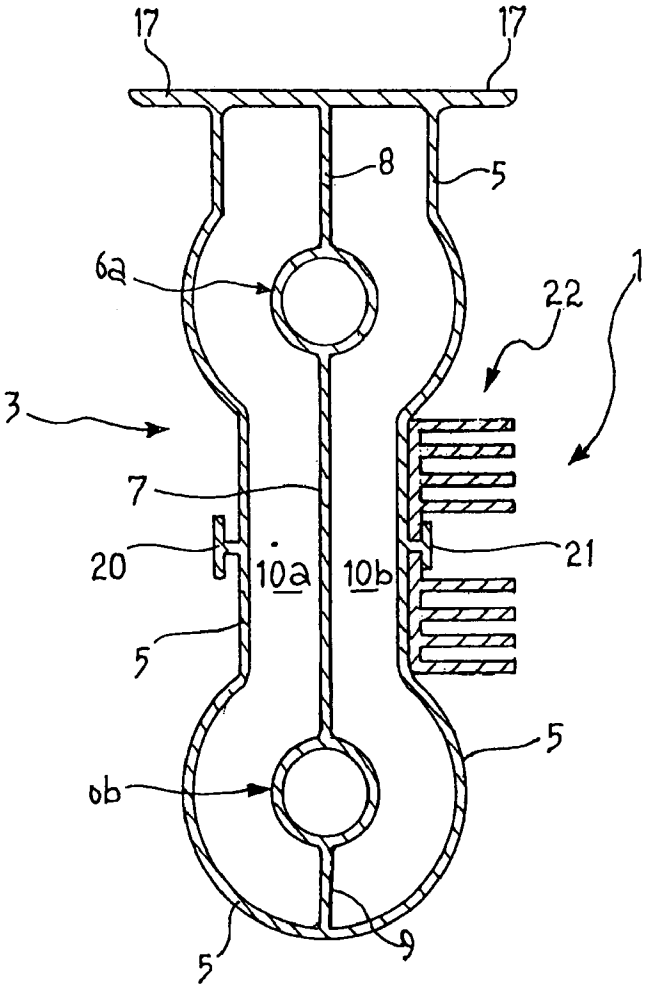

In the variant shown in FIG. 5, the extruded profiled section 3 has two opposed, longitudinal, shaped portions 20 and 21 which are also substantially T-shaped and enable finned frigorie dispersers, such as that generally indicated 22, to be connected to the accumulator.

Figure 6:
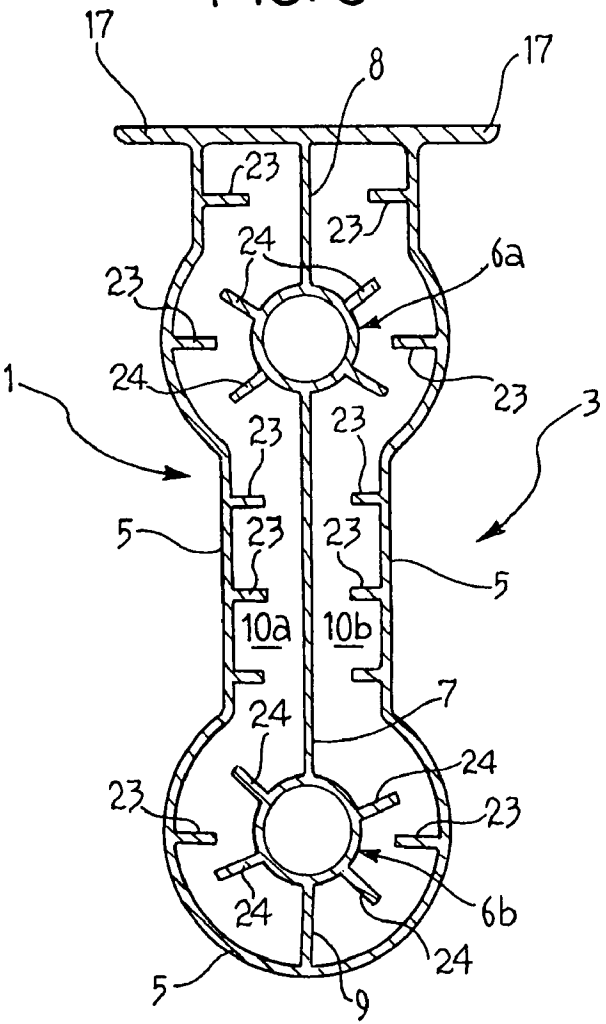

With reference to FIG. 6, the extruded profiled element 3 may comprise internal, longitudinal, shaped portions which are formed integrally therewith during the extrusion process and which extend into the region 10*a*, 10*b* that is intended to hold the storage substance. FIG. 6 shows various substantially fin-like shaped portions of this type, indicated 23.

The internal, tubular, shaped portions 6*a*, 6*b* may also advantageously have respective external, integral, shaped portions which extend into the region 10*a*, 10*b* holding the storage substance. Such shaped portions are indicated 24 in FIG. 6.

Figure 7:
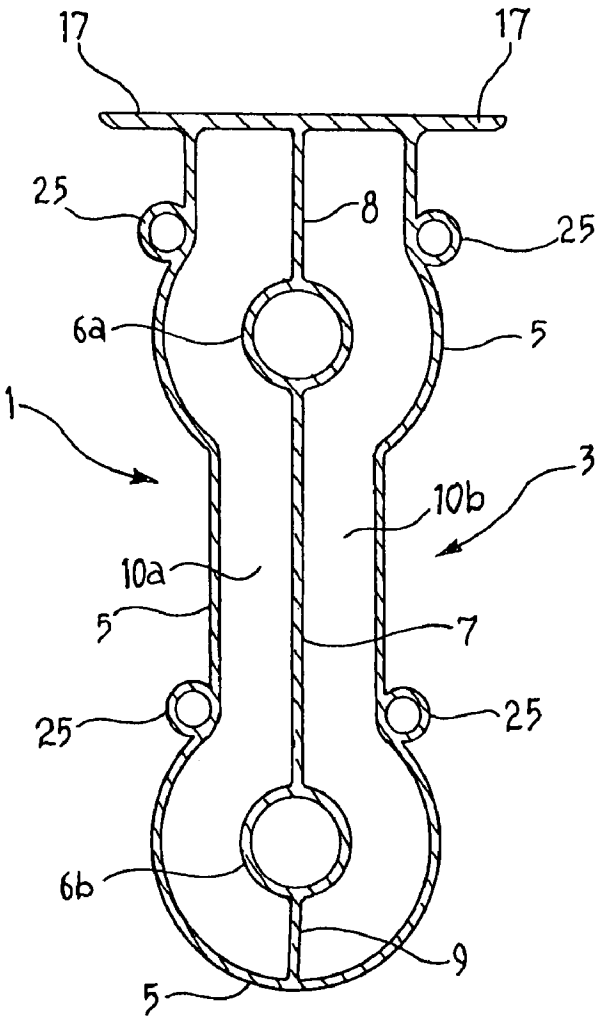

In the further variant shown in FIG. 7, the extruded profiled section 3 has a plurality of integral, external, tubular shaped portions, indicated 25. These shaped portions can be used in order to bring about the flow of a heating fluid therein, in operation, when the accumulator 1 is to be defrosted.

Figure 8:
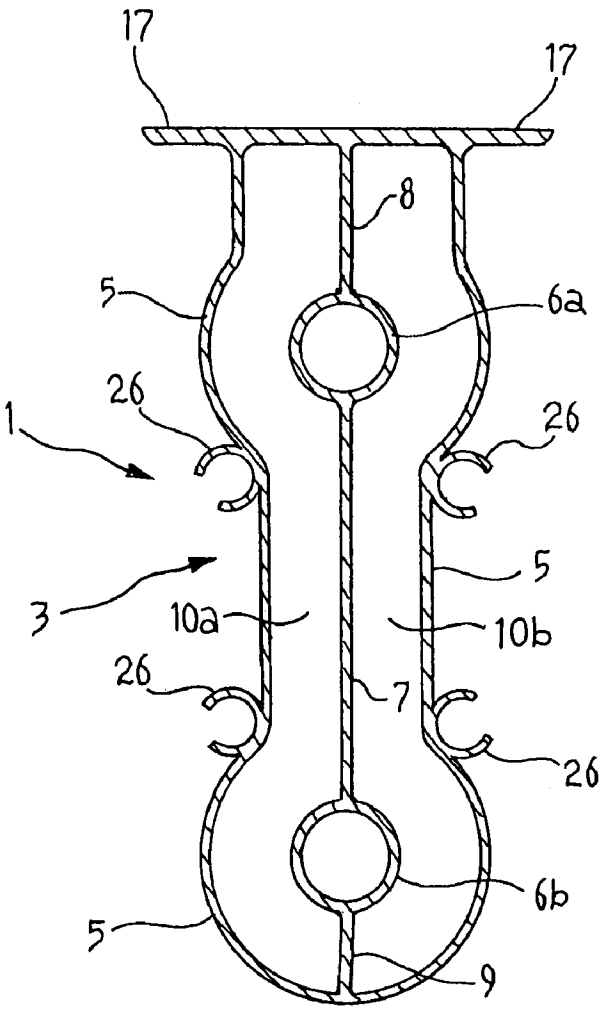

In the further variant shown in FIG. 8, the extruded profiled element 3 has a plurality of substantially channel-shaped, external, shaped portions 26 in which it is possible to engage, for example, resistive heating devices which can be activated when the accumulator is to be defrosted.

Figure 9:
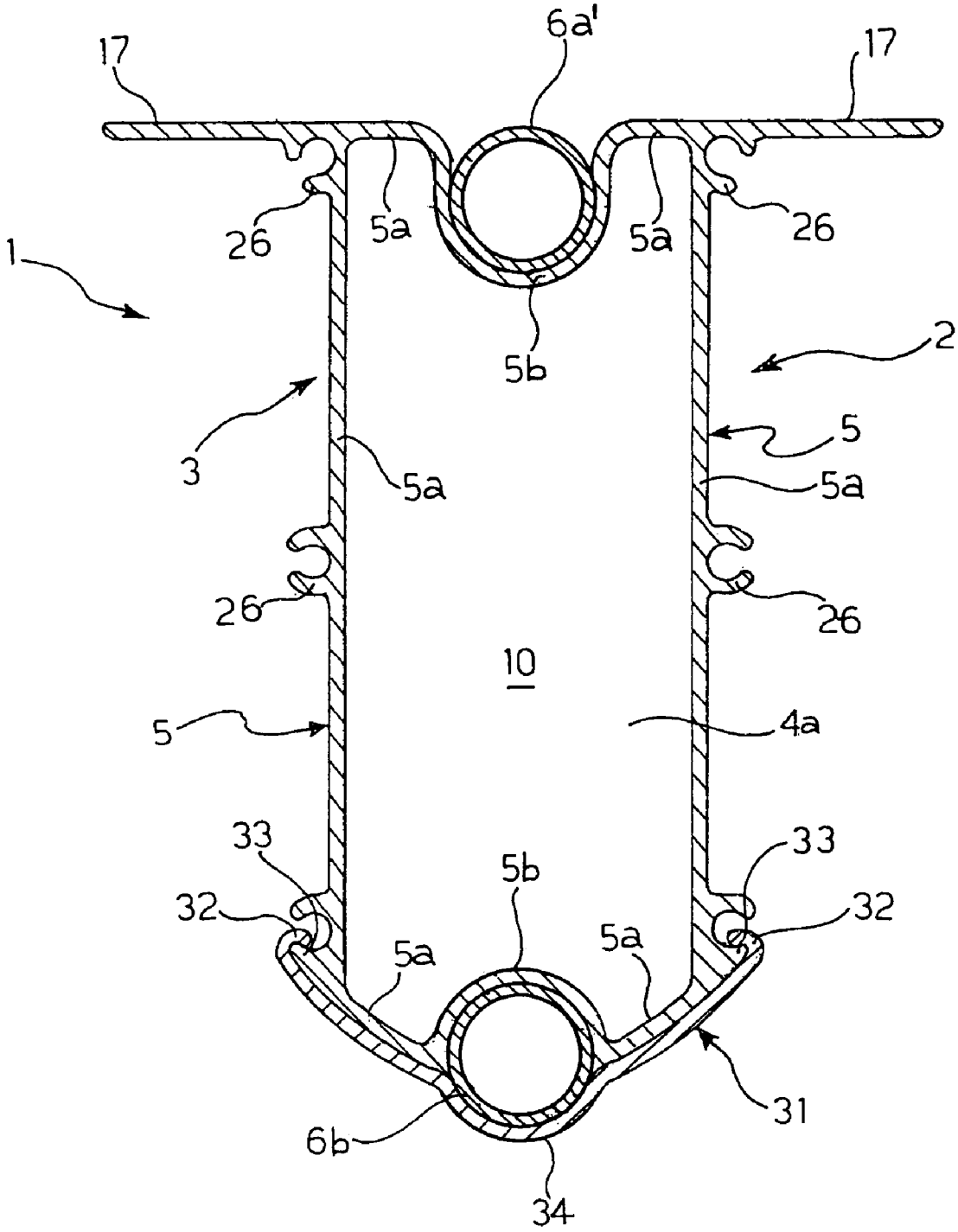
FIGS. 9 and 10 are sectioned views relating to further variants.
Figure 10:
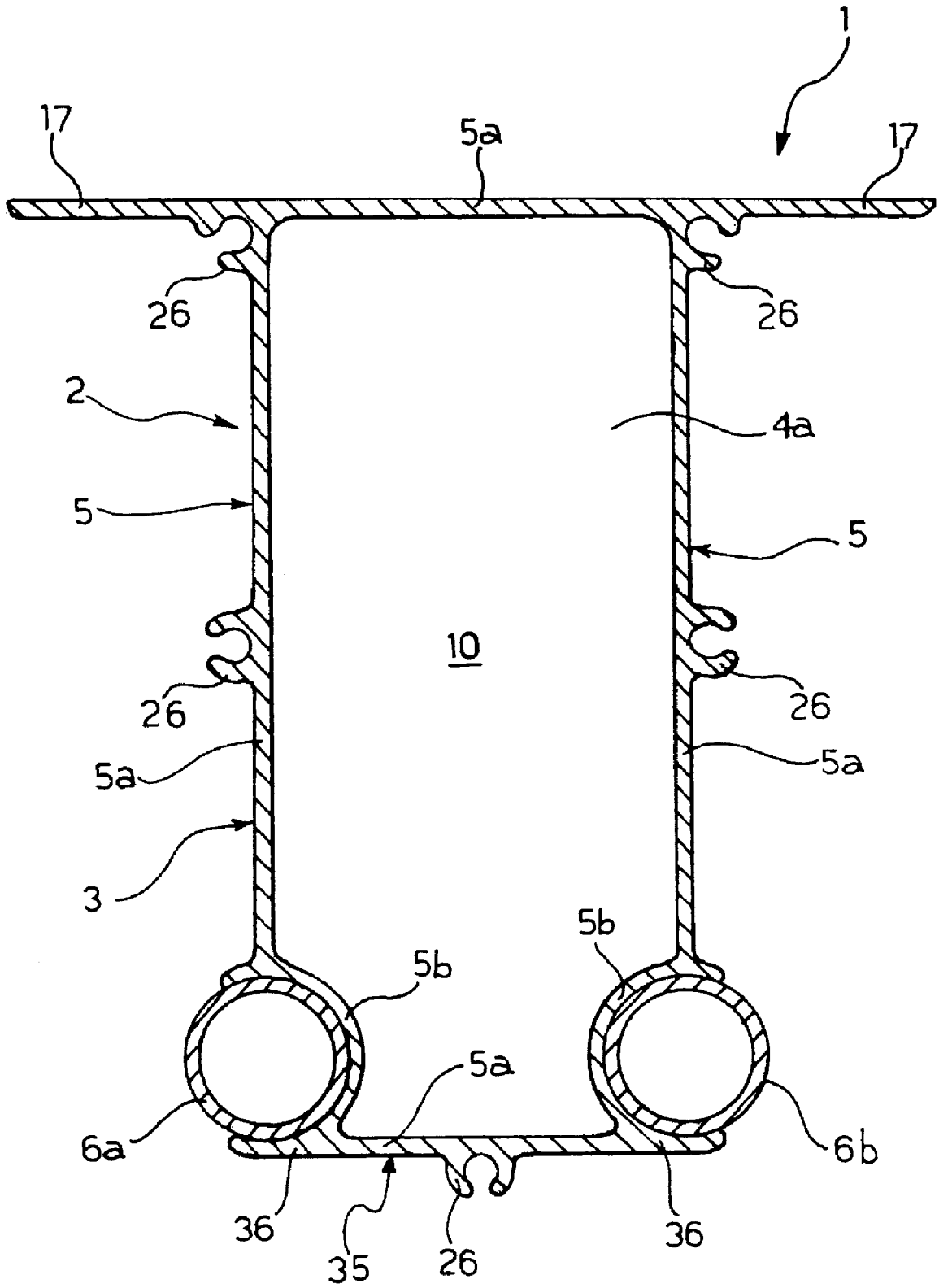

FIGS. 9 and 10 show two variants, wherein the tubular portions, or ducts, 6*a* and 6*b* are now placed externally to the housing 2. In these drawings, parts and elements already described have again been attributed the same alphanumeric references as were used above.

In the variant of FIG. 9, a frigorie accumulator 1 is shown that has an extruded profiled section 3 which does not have the longitudinal partition 7 or the connecting partitions 8 and 9, but which defines a single region, generally indicated 10, inside the housing 2. The extruded profiled section 3 comprises first heat-exchange walls 5*a* between the region 10 inside the housing 2 and the outside environment, and second heat-exchange walls 5*b* between the region 10 and the refrigerant fluid contained in the duct 6*a*, 6*b*.

These second heat-exchange walls 5*b* are channel-shaped wall portions which are open towards the environment outside the profiled section 3, and can receive portions of the duct 6*a*, 6*b* which can advantageously be disposed on opposite sides of the profiled section 3.

In contrast with the embodiments shown in FIGS. 1 to 8, the above-mentioned duct portions 6*a*, 6*b* facing the second heat-exchange walls 5*b* are not welded at their ends to U-shaped or C-shaped tubing portions 15, since the duct 6*a*, 6*b* can advantageously be formed in a single piece as a coil, because it is outside the extruded profiled section 3.

The duct 6*a*, 6*b* can thus easily be disconnected from the housing 2 and is particularly safe in the event of perforation or damage since it cannot cause refrigerant fluid, which is generally subjected to high working pressure, to leak into the region 10 inside the profiled section 3.

FIG. 9 also shows a retaining element 31 which can hold the duct portion 6*b* in contact with the associated channel-like heat-exchange wall 5*b*, in a profile 34 of the retaining element 31.

Advantageously, the retaining element 31 may be made of thermally conductive material and may be connected to the profiled section 3 by means of hooked portions 32 which can snap-engage corresponding shaped engagement portions 33 that are present on the outside of the housing 2.

FIG. 10 shows a variant similar to that shown in FIG. 9 in which the portions 6*a*, 6*b* of the duct are situated in the vicinity of a side 35 of the profiled section 3 which is remote from the flange-like shaped portion 17 and is provided with end appendages 36 which help to hold the duct portions 6*a*, 6*b* in contact with the second heat-exchange wall 5*b*.

Figure 11:
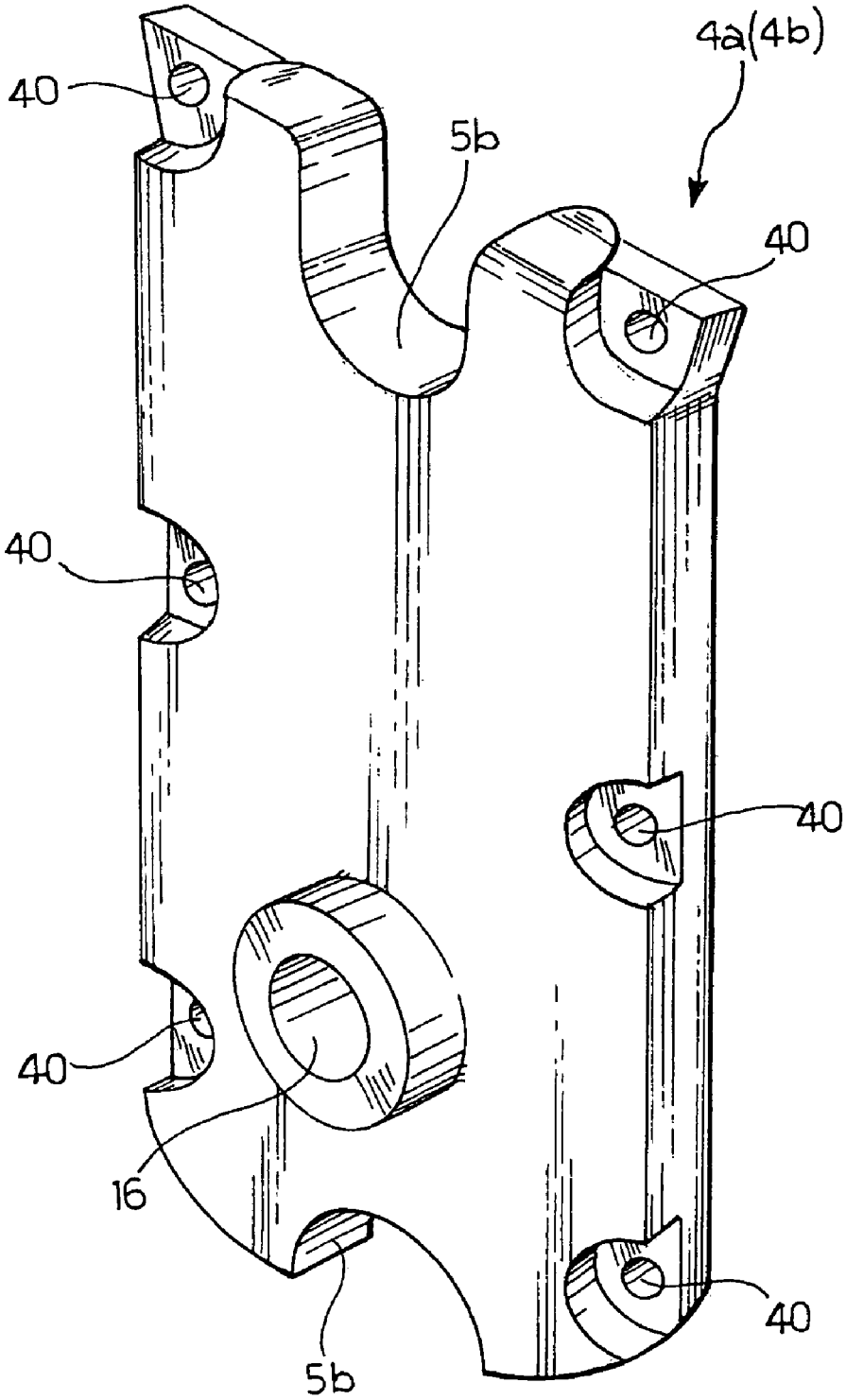
FIG. 11 is a perspective view of an end closure element relating to the variant shown in FIG. 9.

FIG. 11 shows a preferred embodiment of the end closure elements 4*a*, 4*b*, particularly for the variant shown in FIG. 9.

The end element 4*a*, like the end element 4*b*, may advantageously be fixed to the extruded profiled section 3 by mechanical means such as, for example, screws (not shown) fitted in corresponding holes 40 formed in the peripheral end of the end element 4*a* and of the profiled section 3. The fluid-tightness of the housing 2 is advantageously ensured by the interposition of a seal (not shown) between the end element 4*a* and the profiled section 3. Alternatively, the fluid-tightness of the housing 2 can be achieved by means of silicones or other sealing means.

This variant of the end elements 4*a*, 4*b* is particularly advantageous: welding of the elements 4*a*, 4*b* to the profiled section 3 is thus avoided since the welding operation may be problematical owing to the nature of aluminium and of its alloys which are generally used for the manufacture of the housing 2 because of its above-mentioned thermal conductivity properties.

Naturally, the principle of the invention remaining the same, the forms of embodiment and details of construction may be varied widely with respect to those described and illustrated purely by way of non-limiting example, without thereby departing from the scope of the invention as defined in the appended claims.

What is claimed is:

1. A frigorie accumulator unit comprising:

a housing which defines in its interior a single chamber for holding a frigorie storage substance such as a eutectic solution, at least one duct which extends at least partly in a heat-exchange relationship with the chamber inside the housing and is adapted to contain a refrigerant fluid for removing calories from the storage substance held in said chamber of the housing until it brings about freezing thereof;

the housing comprising:

a substantially tubular, extruded profiled section made of a thermally conductive material, defining at least one heat-exchange wall between the chamber inside the housing and the environment outside the housing and at least one heat-exchange wall between the chamber the housing and the refrigerant fluid contained in said duct, and a first end closure element and a second end closure element, adapted to be connected in a fluid-tight manner to the ends of the extruded profiled section, wherein a first and a second duct portion or tube are both externally coupled to said single chamber and are both separate and distinct from the extruded profiled section the extruded profiled section comprising two recessed channel-shaped wall portions which are open towards the environment outside said extruded profiled section and protrude inside said chamber, and in which there are received said duct portions or tubes.

2. A frigorie accumulator according to claim 1 in which said two channel-shaped wall portions are disposed on opposite sides of the extruded profiled section.

3. A frigorie accumulator unit according to claim 1 in which at least one retaining element, connected to the extruded profiled section, is associated with one channel-shaped wall portion and is adapted to hold the associated duct portion therein.

4. A frigorie accumulator unit according to claim 3 in which the retaining element is made of thermally conductive material.

5. A frigorie accumulator unit according to claim 1 in which the end closure elements are connected to the profiled section by fixing and sealing means.

6. A frigorie accumulator unit according to claim 5 in which leak tight seals are interposed between the end closure elements and the profiled section.

7. A frigorie accumulator unit according to claim 1, in which an end closure element of the extruded profiled section has an opening which is adapted to be closed in a leak tight manner and which enables the storage substance to be introduced into the chamber defined inside the housing.

8. A frigorie accumulator unit according to claim 1, in which the extruded profiled section has, on one side, at least one integral, flange-like, shaped portion which is adapted to be used for the fixing of the accumulator unit to a supporting structure.

9. A frigorie accumulator unit according to claim 1, in which the extruded profiled section has (first) integral, external, longitudinal, shaped portions for enabling accessory elements to be connected to the accumulator unit.

10. A frigorie accumulator unit according to claim 9 in which the extruded profiled section has channel-like, external, longitudinal, shaped portions which are integral therewith, and which are adapted to hold heating devices for the defrosting of the accumulator unit.

* * * * *